US007626343B2

(12) United States Patent
Ger et al.

(10) Patent No.: US 7,626,343 B2
(45) Date of Patent: Dec. 1, 2009

(54) DRIVING DEVICE FOR DISCHARGE LAMPS AND VOLTAGE DETECTION CIRCUIT USED THEREIN

(75) Inventors: Chih-Chan Ger, Tu-Cheng (TW); Ko-Wen Wang, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 468 days.

(21) Appl. No.: 11/309,920

(22) Filed: Oct. 27, 2006

(65) Prior Publication Data

US 2007/0200511 A1 Aug. 30, 2007

(30) Foreign Application Priority Data

Dec. 3, 2005 (TW) ..... 94147438 A

(51) Int. Cl.
*H05B 37/02* (2006.01)

(52) U.S. Cl. ..... 315/291; 315/307; 315/308; 315/219; 315/119; 315/129; 361/90

(58) Field of Classification Search ..... 315/119, 315/129, 219, 224, 244, 307, 308, 291; 361/90, 361/88, 78, 86, 91.1
See application file for complete search history.

(56) References Cited

U.S. PATENT DOCUMENTS 6,710,555 B1 3/2004 Terada et al.
6,900,599 B2 * 5/2005 Ribarich ..... 315/291
6,900,600 B2 * 5/2005 Rust et al. ..... 315/291
6,900,993 B2 * 5/2005 Lin et al. ..... 315/307
7,187,135 B2 * 3/2007 Yiu ..... 315/219
7,411,360 B2 * 8/2008 Henry ..... 315/307

FOREIGN PATENT DOCUMENTS

CN 2344942 Y 10/1999
CN 1480734 A 3/2004
CN 1585586 A 2/2005

* cited by examiner

*Primary Examiner*—Douglas W Owens
*Assistant Examiner*—Ephrem Alemu
(74) *Attorney, Agent, or Firm*—Wei Te Chung

(57) ABSTRACT

A voltage detection circuit includes a voltage obtaining circuit for transforming an AC signal into a voltage signal, an over-voltage detection circuit connected to the voltage obtaining circuit, and an under-voltage detection circuit connected to the voltage obtaining circuit. The over-voltage detection circuit is for determining whether the AC signal is over-voltage, and generating an over-voltage signal if the voltage signal is over-voltage. The over-voltage detection circuit includes a first transistor. The first transistor includes a first control electrode electrically connected to the voltage obtaining circuit, a first electrode, and a second electrode. The under-voltage detection circuit is for determining whether the AC signal is under-voltage, and generating an under-voltage signal if the voltage signal is under-voltage. The under-voltage detection circuit includes a second transistor. The second transistor includes a second control electrode electrically connected to the voltage obtaining circuit, a third electrode, and a fourth electrode.

20 Claims, 5 Drawing Sheets

DRIVING DEVICE FOR DISCHARGE LAMPS AND VOLTAGE DETECTION CIRCUIT USED THEREIN

FIELD OF THE INVENTION

The invention relates to electronic driving devices, and particularly to a driving device for driving discharge lamps.

DESCRIPTION OF RELATED ART

Conventionally, a liquid crystal display (LCD) panel uses discharge lamps, such as cold cathode fluorescent lamps (CCFLs), as a light source of a backlight system. Typically, an inverter circuit can output alternating current (AC) signals to drive the CCFLs. If a voltage of the AC signal output by the inverter circuit is over-voltage, the CCFLs may be damaged; and if the voltage of the AC signal output by the inverter circuit is under-voltage, the CCFLs cannot be started. Therefore, a voltage detection circuit and a protection circuit are required in the inverter circuit.

Referring to FIG. 4, a block diagram of a conventional driving device 10 for driving a lamp module 140 is shown. The driving device 10 includes a driving circuit 100, a transformer circuit 110, a protection circuit 120, and a voltage detection circuit 130. The transformer circuit 110 outputs an AC signal to the lamp module 140. The voltage detection circuit 130 transforms the AC signal into a voltage signal via three capacitors C1, C2, and C3 of the voltage detection circuit 130. If the voltage signal is over voltage, after rectification of the voltage signal by a half-wave rectifier D1 of the voltage detection circuit 130, the voltage detection circuit 130 directly outputs an over-voltage signal to the protection circuit 120. However, this device fails to provide under-voltage protection.

FIG. 5 is a block diagram of another conventional driving device 10' for driving a lamp module 140. Modules of the driving device 10' are the same as those of the driving device 10 except a voltage detection circuit 130' and a protection circuit 120'. The transformer circuit 110 outputs an AC signal to the lamp module 140. The voltage detection circuit 130' transforms the AC signal into a voltage signal via three capacitors C1, C2, and C3 of the voltage detection circuit 130'. If the voltage signal is abnormal, after a half-wave rectifier D1 rectifies the voltage signal and two diodes D2 and D3 divide the voltage signal, the voltage detection circuit 130' outputs an under-voltage signal or an over-voltage signal to the protection circuit 120'. However, this device is susceptible to interference, and circuit impedances thereof are high.

Therefore, a heretofore unaddressed need exists in the industry to overcome the aforementioned deficiencies and inadequacies.

SUMMARY OF THE INVENTION

In one aspect of the embodiment, a driving device for driving discharge lamps includes a driving circuit, a transformer circuit, and a voltage detection circuit. The driving circuit is for transforming an input DC signal into a first AC signal. The transformer circuit is electrically connected to the driving circuit, and is for transforming the first AC signal into a second AC signal to drive the discharge lamps. The voltage detection circuit for determining whether the second AC signal flowing through the discharge lamps is over-voltage or under-voltage, includes a voltage obtaining circuit, an over-voltage detection circuit, and an under-voltage detection circuit. The voltage obtaining circuit is for transforming the second AC signal flowing through the discharge lamps into a voltage signal. The over-voltage detection circuit is electrically connected to the voltage obtaining circuit, and is for determining whether the second AC signal flowing through the discharge lamps is over-voltage according to the voltage signal and generating an over-voltage signal if the voltage signal is over-voltage. The over-voltage detection circuit includes a first transistor, and the first transistor includes a first control electrode electrically connected to the voltage obtaining circuit. The under-voltage detection circuit is electrically connected to the voltage obtaining circuit, and is for determining whether the second AC signal flowing through the discharge lamps is under-voltage according to the voltage signal and generating an under-voltage signal if the voltage signal is under-voltage. The under-voltage detection circuit includes a second transistor, and the second transistor includes a second control electrode electrically connected to the voltage obtaining circuit.

In another aspect of the embodiment, a voltage detection circuit for determining whether an AC signal flowing through discharge lamps is over-voltage or under-voltage includes a voltage obtaining circuit, an over-voltage detection circuit, and an under-voltage detection circuit. The voltage obtaining circuit is for transforming the AC signal into a voltage signal. The over-voltage detection circuit is electrically connected to the voltage obtaining circuit, and is for determining whether the AC signal is over-voltage according to the voltage signal and generating an over-voltage signal if the voltage signal is over-voltage. The over-voltage detection circuit includes a first transistor, and the first transistor includes a first electrode, a second electrode, and a first control electrode electrically connected to the voltage obtaining circuit. The under-voltage detection circuit is electrically connected to the voltage obtaining circuit, and is for determining whether the AC signal is under-voltage according to the voltage signal and generating an under-voltage signal if the voltage signal is under-voltage. The under-voltage detection circuit includes a second transistor, and the second transistor includes a third electrode, a fourth electrode, and a second control electrode electrically connected to the voltage obtaining circuit.

Other advantages and novel features will become more apparent from the following detailed description when taken in conjunction with the accompanying drawings, in which:

DETAILED DESCRIPTION OF THE INVENTION

Figure 1:
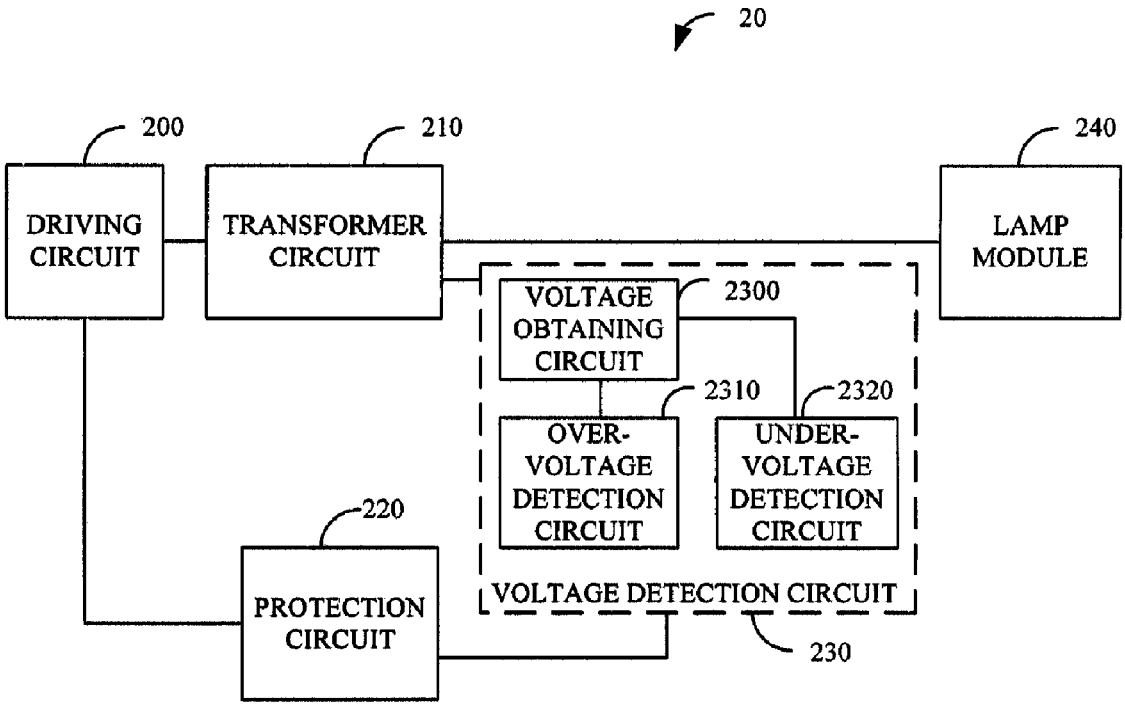
FIG. 1 is a block diagram of a driving device for driving discharge lamps according to an exemplary embodiment of the present invention.

FIG. 1 is a block diagram of a driving device 20 for driving a lamp module 240 according to an exemplary embodiment of the present invention. In the exemplary embodiment, the driving device 20 includes a driving circuit 200, a transformer circuit 210, a protection circuit 220, and a voltage detection circuit 230.

The driving circuit 200 is used for transforming a direct current (DC) signal into a first AC signal, and outputting the first AC signal to the transformer circuit 210. In the exemplary embodiment, the first AC signal output by the driving circuit 200 may be a square wave signal. The transformer circuit 210 is electrically connected to the driving circuit 200, and is used for transforming the first AC signal into a second AC signal, and outputting the second AC signal to the lamp module 240 to drive the lamp module 240. In the exemplary embodiment, the second AC signal may be a sine wave signal.

The voltage detection circuit 230 is used for determining whether AC signals flowing through the lamp module 240 are over-voltage or under-voltage. In the exemplary embodiment, the voltage detection circuit 230 is electrically connected to the transformer circuit 210 for determining whether the second AC signal flowing through the lamp module 240 is over-voltage or under-voltage. If the second AC signal of the transformer circuit 210 is over-voltage, the voltage detection circuit 230 outputs an over-voltage signal; and if the second AC signal of the transformer circuit 210 is under-voltage, the voltage detection circuit 230 outputs an under-voltage signal.

The voltage detection circuit 230 includes a voltage obtaining circuit 2300, an over-voltage detection circuit 2310, and an under-voltage detection circuit 2320.

The voltage obtaining circuit 2300 is used for transforming AC signals flowing through the lamp module 240 into voltage signals. In the exemplary embodiment, the voltage obtaining circuit 2300 is used for transforming the second AC signal output by the transformer circuit 210 into a voltage signal.

The over-voltage detection circuit 2310 is electrically connected to the voltage obtaining circuit 2300, and is used for determining whether the second AC signal is over-voltage according to the voltage signal outputted by the voltage obtaining circuit 2300, and generating the over-voltage signal if the voltage signal is over-voltage.

The under-voltage detection circuit 2320 is electrically connected to the voltage obtaining circuit 2300, and is used for determining whether the second AC signal is under-voltage according to the voltage signal output by the voltage obtaining circuit 2300, and generating the under-voltage signal if the voltage signal is under-voltage.

The protection circuit 220 is electrically connected to the voltage detection circuit 230 and the driving circuit 200, and is used for controlling the driving circuit 200 according to the over-voltage signal and/or the under-voltage signal generated by the voltage detection circuit 230.

Figure 2:
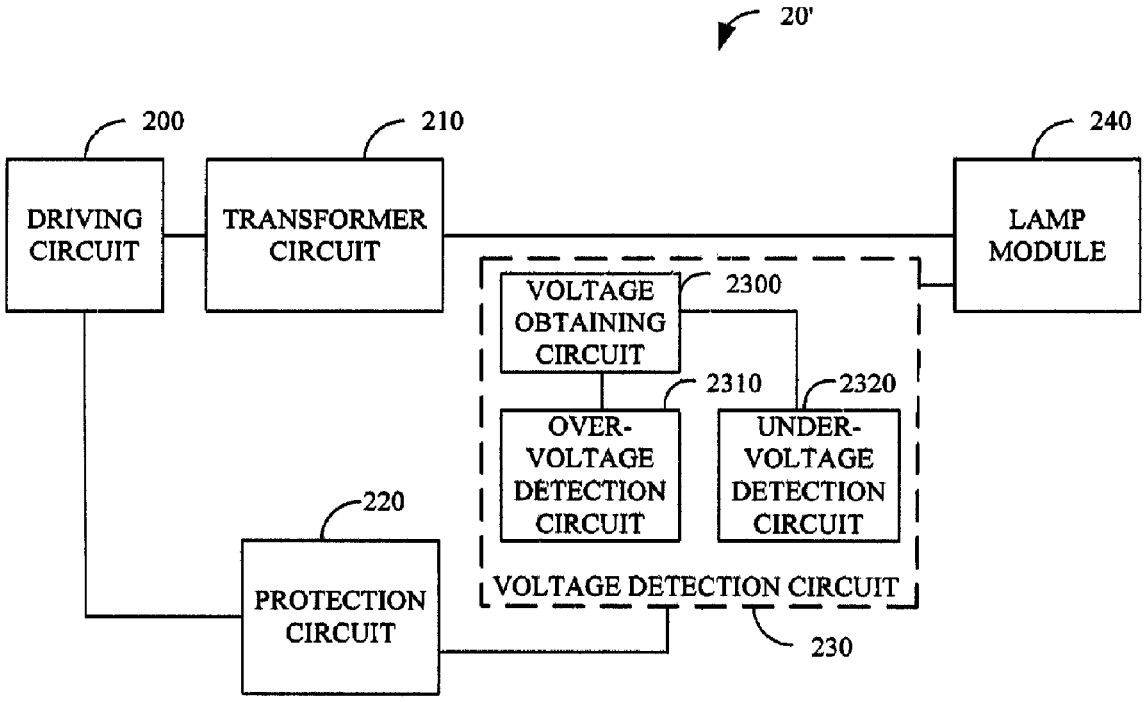
FIG. 2 is a block diagram of a driving device for driving discharge lamps according to another exemplary embodiment of the present invention.

FIG. 2 is a block diagram of a driving device 20' for driving a lamp module 240 according to another exemplary embodiment of the present invention. In the exemplary embodiment, the voltage detection circuit 230 of the driving device 20' is electrically connected to the lamp module 240, and other parts of the driving device 20' are the same as those of the driving device 20 of FIG. 1. Therefore, descriptions of the driving device 20' are omitted.

Figure 3:
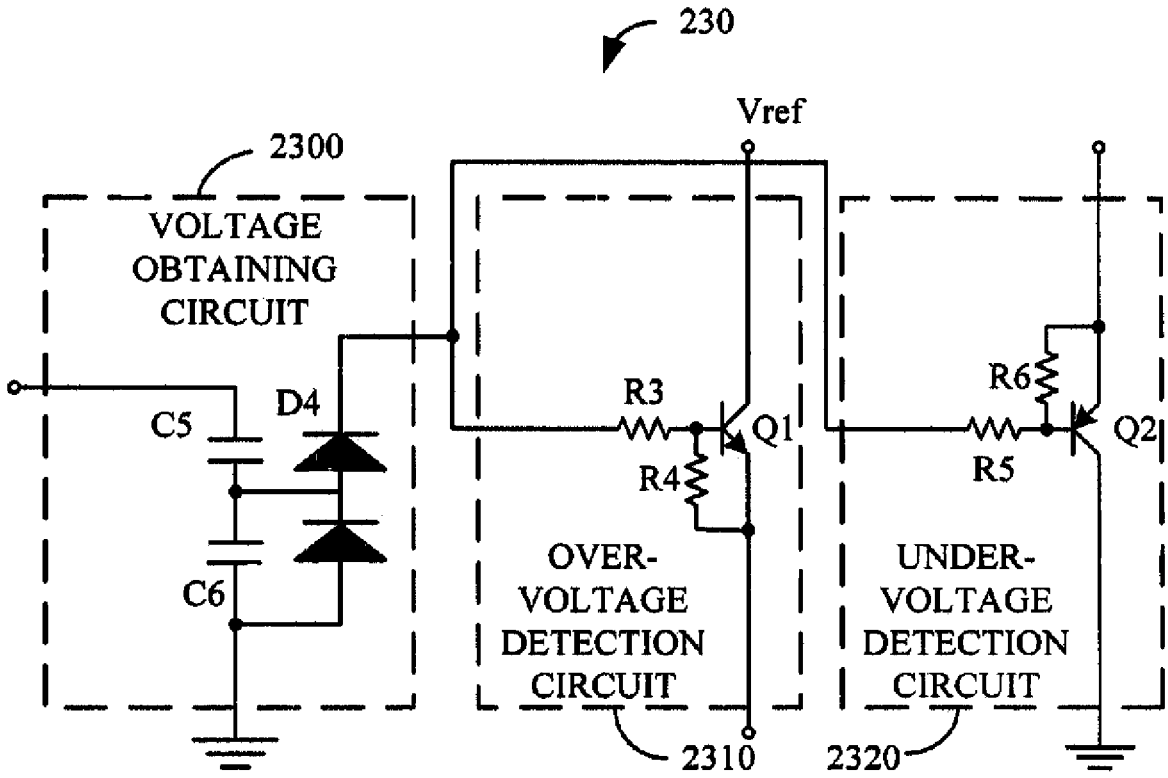
FIG. 3 is a circuit diagram of a voltage detection circuit of a driving device according to a further exemplary embodiment of the present invention.
Figure 4:
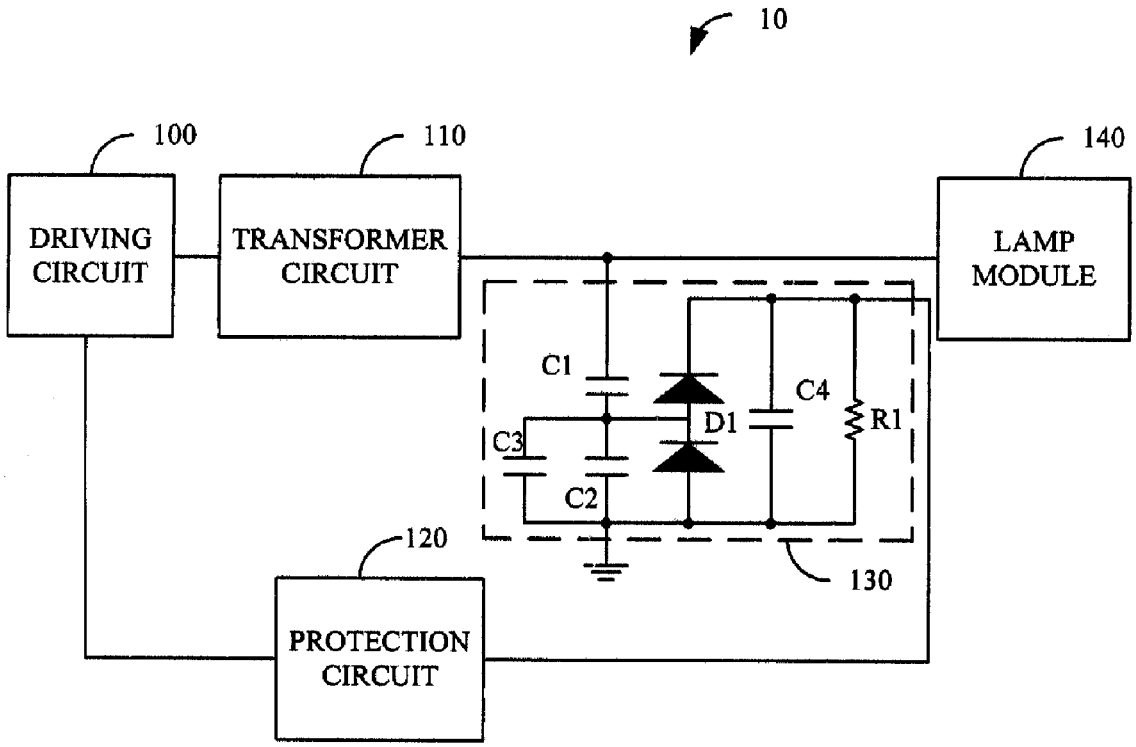
FIG. 4 (RELATED ART)
FIG. 4 is a block diagram of a conventional driving device for driving discharge lamps.
Figure 5:
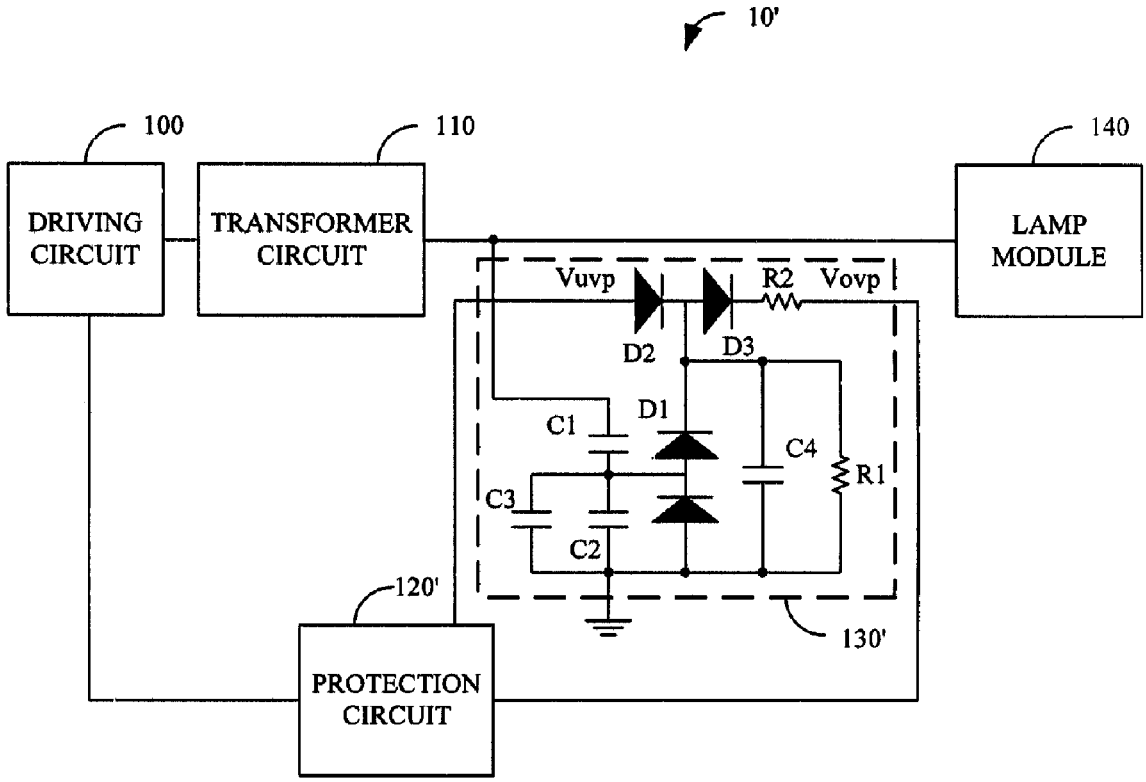
FIG. 5 (RELATED ART)
FIG. 5 is a block diagram of another conventional driving device for driving discharge lamps.

FIG. 3 is a circuit diagram of the voltage detection circuit 230 of the driving device 20 or 20' according to an exemplary embodiment of the present invention. In the exemplary embodiment, the voltage obtaining circuit 2300 includes a first capacitor C5, a second capacitor C6, and a half-wave rectifier D4. One end of the first capacitor C5 receives the AC signal flowing through the lamp module 240, the other end of the first capacitor C5 is electrically connected to one end of the second capacitor C6, and the other end of the second capacitor C6 is grounded.

In the exemplary embodiment of FIG. 1, one end of the first capacitor C5 is electrically connected to the transformer circuit 210. In the exemplary embodiment of the FIG. 2, one end of the first capacitor C5 is electrically connected to the lamp module 240.

In the exemplary embodiment, the half-wave rectifier D4 includes a first diode and a second diode. An anode of the first diode is a first end of the half-wave rectifier D4. A cathode of the first diode electrically connected to an anode of the second diode is a second end of the half-wave rectifier D4. A cathode of the second diode is a third end of the half-wave rectifier D4. The first end of the half-wave rectifier D4 is grounded, the second end is electrically connected between the first capacitor C5 and the second capacitor C6, and the third end is electrically connected to the over-voltage detection circuit 2310 and the under-voltage detection circuit 2320.

The over-voltage detection circuit 2310 includes a first transistor Q1. The first transistor Q1 includes a first control electrode, a first electrode, and a second electrode. The first control electrode is electrically connected to the third end of the half-wave rectifier D4 of the voltage obtaining circuit 2300. The first electrode of the first transistor Q1 is electrically connected to a reference voltage Vref, and the second electrode of the first transistor Q1 outputs the over-voltage signal.

In the exemplary embodiment, the first control electrode is electrically connected to the voltage obtaining circuit 2300 via a first resistor R3, and is electrically connected to the second electrode via a second resistor R4. The first resistor R3 and the second resistor R4 are used for dividing. In the exemplary embodiment, the reference voltage Vref is 12V. In other exemplary embodiments of the present invention, the reference voltage Vref may be 15V.

In the exemplary embodiment, the first transistor Q1 is a NPN-transistor, the first control electrode is a base, the first electrode is a collector, and the second electrode is an emitter. In other exemplary embodiments of the present invention, the first transistor Q1 may be transistors of other types.

The under-voltage detection circuit 2320 includes a second transistor Q2. The second transistor Q2 includes a second control electrode, a third electrode, and a forth electrode. The second control electrode is electrically connected to the third end of the half-wave rectifier D4 of the voltage obtaining circuit 2300. The third electrode of the second transistor Q2 outputs the under-voltage signal, and the fourth electrode of the second transistor Q2 is grounded.

In the exemplary embodiment, the second control electrode is electrically connected to the voltage obtaining circuit 2300 via a third resistor R5, and is electrically connected to the third electrode via a fourth resistor R6. The third resistor R5 and the fourth resistor R6 are used for dividing.

In the exemplary embodiment, the second transistor Q2 is a PNP-transistor, the second control electrode is a base, the third electrode is an emitter, and the fourth electrode is a collector. In other exemplary embodiments of the present invention, the second transistor Q2 may be transistors of other types.

The AC signal flowing through the lamp module 240 is transformed into the voltage signal by the first capacitor C5 and the second capacitor C6, and the voltage signal is transformed into a DC signal by the half-wave rectifier D4. If the AC signal flowing through the lamp module 240 is normal, the first transistor Q1 and the second transistor Q2 are turned off, and there is no over-voltage signal or under-voltage signal generated from the first transistor Q1 and the second transistor Q2.

If the second AC signal flowing through the lamp module 240 is over-voltage, the first transistor Q1 is turned on, the second transistor Q2 is turned off, and the second electrode of the first transistor Q1 outputs the over-voltage signal to the protection circuit 220. In the exemplary embodiment, the over-voltage signal may be a DC signal.

If the second AC signal flowing through the lamp module 240 is under-voltage, the first transistor Q1 is turned off, the second transistor Q2 is turned on, and the third electrode of the second transistor Q2 outputs the under-voltage signal to the protection circuit 220. In the exemplary embodiment, the under-voltage signal may be a DC signal.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A driving device for driving discharge lamps, comprising:

a driving circuit, for transforming an inputting DC signal into a first AC signal;

a transformer circuit electrically connected to the driving circuit, for transforming the first AC signal into a second AC signal to drive the discharge lamps; and a voltage detection circuit, for determining whether the second AC signal flowing through the discharge lamps is over-voltage or under-voltage, the voltage detection circuit comprising:

a voltage obtaining circuit, for transforming the second AC signal flowing through the discharge lamps into a voltage signal;

an over-voltage detection circuit electrically connected to the voltage obtaining circuit, for determining whether the second AC signal flowing through the discharge lamps is over-voltage according to the voltage signal, and generating an over-voltage signal if the voltage signal is over-voltage, the over-voltage detection circuit comprising a first transistor, the first transistor comprising a first control electrode electrically connected to the voltage obtaining circuit; and an under-voltage detection circuit electrically connected to the voltage obtaining circuit, for determining whether the second AC signal flowing through the discharge lamps is under-voltage according to the voltage signal, and generating an under-voltage signal if the voltage signal is under-voltage, the under-voltage detection circuit comprising a second transistor, the second transistor comprising a second control electrode electrically connected to the voltage obtaining circuit.

2. The driving device of claim 1, further comprising a protection circuit electrically connected to the voltage detection circuit and the driving circuit, for controlling the driving circuit according to the over-voltage signal and/or the under-voltage signal.

3. The driving device of claim 1, wherein the first AC signal output by the driving circuit is a square wave signal, and the second AC signal output by the transformer circuit is a sine wave signal.

4. The driving device of claim 1, wherein the first transistor further comprises a first electrode electrically connected to a reference voltage and a second electrode outputting the over-voltage signal.

5. The driving device of claim 4, wherein the first control electrode of the first transistor is electrically connected to the voltage obtaining circuit via a first resistor, and is electrically connected to the second electrode via a second resistor.

6. The driving device of claim 4, wherein the first transistor is a NPN-transistor, the first control electrode is a base, the first electrode is a collector, and the second electrode is an emitter.

7. The driving device of claim 1, wherein the second transistor further comprises a third electrode outputting the under-voltage signal and a fourth electrode grounded.

8. The driving device of claim 7, wherein the second control electrode of the second transistor is electrically connected to the voltage obtaining circuit via a third resistor, and is electrically connected to the third electrode via a fourth resistor.

9. The driving device of claim 7, wherein the second transistor is a PNP-transistor, the second control electrode is a base, the third electrode is an emitter, and the fourth electrode is a collector.

10. The driving device of claim 1, wherein the voltage obtaining circuit comprises:

a first capacitor having one end for receiving the second AC signal flowing through the discharge lamps;

a second capacitor having one end electrically connected to the other end of the first capacitor, and the other end for grounding; and a half-wave rectifier comprising a first end grounded, a second end electrically connected to the other end of the first capacitor, and a third end electrically connected to the over-voltage detection circuit and the under-voltage detection circuit.

11. A voltage detection circuit for determining whether an AC signal flowing through discharge lamps is over-voltage or under-voltage, comprising:

a voltage obtaining circuit, for transforming the AC signal into a voltage signal;

an over-voltage detection circuit electrically connected to the voltage obtaining circuit, for determining whether the AC signal is over-voltage according to the voltage signal, and generating an over-voltage signal if the voltage signal is over-voltage, the over-voltage detection circuit comprising a first transistor, the first transistor comprising a first control electrode electrically connected to the voltage obtaining circuit, a first electrode, and a second electrode; and an under-voltage detection circuit electrically connected to the voltage obtaining circuit, for determining whether the AC signal is under-voltage according to the voltage signal, and generating an under-voltage signal if the voltage signal is under-voltage, the under-voltage detection circuit comprising a second transistor, the second transistor comprising a second control electrode electrically connected to the voltage obtaining circuit, a third electrode, and a fourth electrode.

12. The voltage detection circuit of claim 11, wherein the first electrode of the first transistor is electrically connected to a reference voltage, and the second electrode of the first transistor outputs the over-voltage signal.

13. The voltage detection circuit of claim 12, wherein the first control electrode of the first transistor is electrically connected to the voltage obtaining circuit via a first resistor, and is electrically connected to the second electrode via a second resistor.

14. The voltage detection circuit of claim 12, wherein the first transistor is a NPN-transistor, the first control electrode is a base, the first electrode is a collector, and the second electrode is an emitter.

15. The voltage detection circuit of claim 11, wherein the third electrode of the second transistor outputs the under-voltage signal, and the fourth electrode of the second transistor is grounded.

16. The voltage detection circuit of claim 15, wherein the second control electrode of the second transistor is electrically connected to the voltage obtaining circuit via a third resistor, and is electrically connected to the third electrode via a fourth resistor.

17. The voltage detection circuit of claim 15, wherein the second transistor is a PNP-transistor, the second control electrode is a base, the third electrode is an emitter, and the fourth electrode is a collector.

18. The voltage detection circuit of claim 11, wherein the voltage obtaining circuit comprises:

a first capacitor having one end for receiving the AC signal flowing through the discharge lamps;

a second capacitor having one end electrically connected to the other end of the first capacitor, and the other end for grounding; and a half-wave rectifier comprising a first end grounded, a second end electrically connected to the other end of the first capacitor, and a third end electrically connected to the over-voltage detection circuit and the under-voltage detection circuit.

19. A driving device for driving discharge lamps, comprising:

a driving circuit for transforming an inputting direct current (DC) signal into a first alternating current (AC) signal;

a transformer circuit electrically connectable between said driving circuit and discharge lamps for transforming said first AC signal from said driving circuit into a second AC signal to drive said discharge lamps;

a voltage detection circuit electrically connectable with one of said transformer circuit and said discharge lamps to retrieve said second AC signal therefrom, said voltage detection circuit comprising a first transistor and a second transistor, and said first and second transistors functioning oppositely so as to generate over-voltage detection signals and under-voltage detection signals, respectively, according to said retrieved second AC signal; and a protection circuit electrically connectable between said voltage detection circuit and said driving circuit so as to control said driving circuit for output of said first AC signal according to one of said generated over-voltage detection signals and under-voltage detection signals from said voltage detection circuit.

20. The driving device of claim 19, wherein said first transistor is a NPN-transistor and said second transistor is a PNP-transistor.

* * * * *

UNITED STATES PATENT AND TRADEMARK OFFICE

CERTIFICATE OF CORRECTION

PATENT NO. : 7,626,343 B2
APPLICATION NO. : 11/309920
DATED : December 1, 2009
INVENTOR(S) : Ger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 503 days.

Signed and Sealed this

Second Day of November, 2010

David J. Kappos

David J. Kappos
*Director of the United States Patent and Trademark Office*